US005475367A

United States Patent [19]

Prevost

[11] Patent Number: 5,475,367

[45] Date of Patent: Dec. 12, 1995

[54] SYSTEM FOR SURVEILLANCE OF A FIXED OR MOVABLE OBJECT

[75] Inventor: Gilles Prevost, Le Grand Quevilly, France

[73] Assignee: L'Entreprise Industrielle, France

[21] Appl. No.: 162,194

[22] PCT Filed: Apr. 14, 1993

[86] PCT No.: PCT/FR93/00372

§ 371 Date: Dec. 16, 1993

§ 102(e) Date: Dec. 16, 1993

[87] PCT Pub. No.: WO93/21614

PCT Pub. Date: Oct. 28, 1993

[30] Foreign Application Priority Data

Apr. 17, 1992 [FR] France ..... 92 04746

[51] Int. Cl.[6] ..... G08B 13/14

[52] U.S. Cl. ..... 340/568; 340/552; 340/555; 340/571

[58] Field of Search ..... 340/568, 555, 340/522, 531, 539, 505, 693, 572, 825.36, 825.49

[56] References Cited

U.S. PATENT DOCUMENTS 3,597,755 8/1971 Parkin ..... 340/555

5,068,643 11/1991 Yashina ..... 340/522

5,317,309 5/1994 Vercellotti et al. ..... 340/568

FOREIGN PATENT DOCUMENTS 2591372 6/1987 France .

3525265 1/1987 Germany .

*Primary Examiner*—John K. Peng

*Assistant Examiner*—Benjamin C. Lee

*Attorney, Agent, or Firm*—Larson and Taylor

[57] ABSTRACT

A system for surveillance of a mobile or movable object is placed in a surveillance enclosure. The system includes and it comprises a transmitter/receiver circuit for first and second object-monitoring signals (sco1, sco2). The first and second signals monitor the presence of the object and the position of the object respectively. A transmission circuit is provided for transmitting an alarm-triggering signal. The transmission circuit receives the first and second object-monitoring signals and enables an alarm-triggering signal (sda) to be transmitted conditionally on the basis of a logical and/or analog combination of the first and second object-monitoring signals. The invention is applicable to surveillance of valuables or of works of art.

19 Claims, 9 Drawing Sheets

Figure 2B:
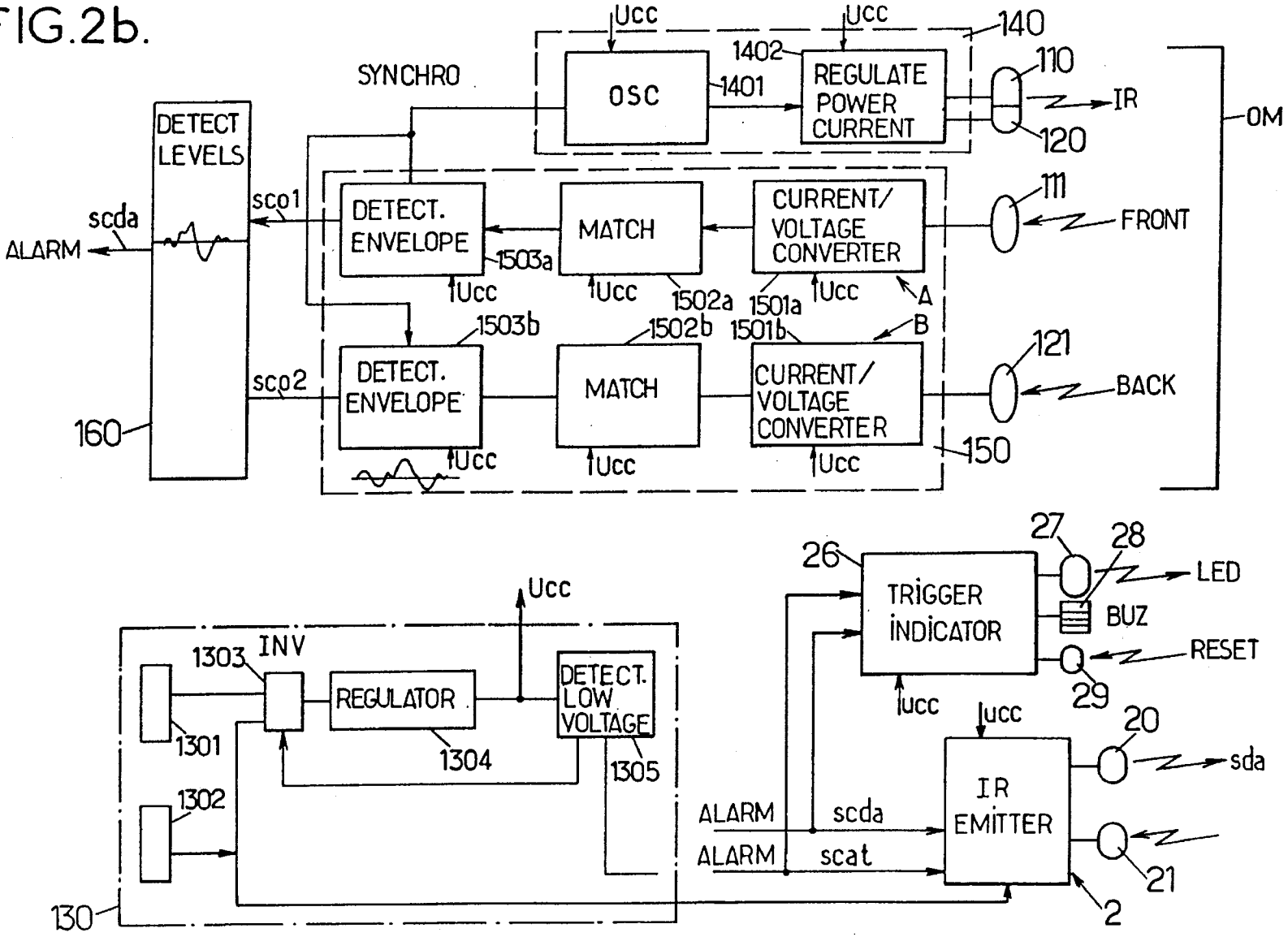
Figure 3A:
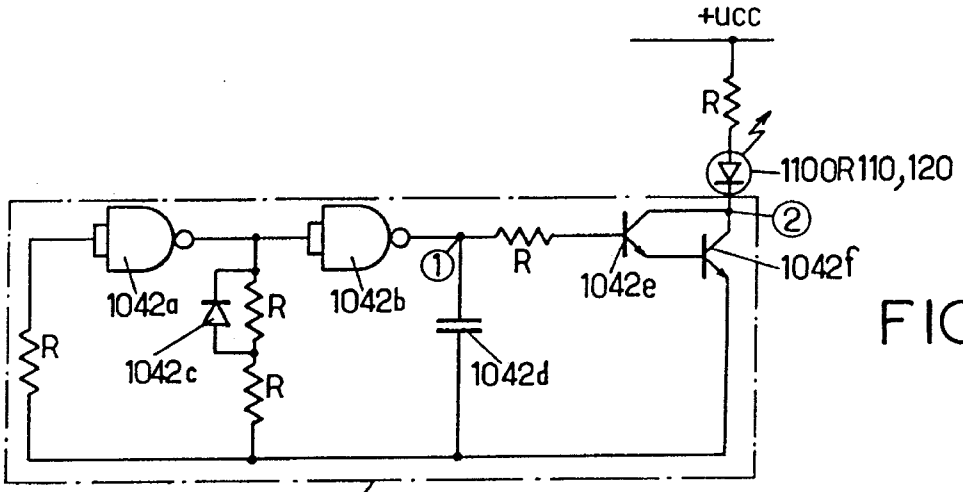
Figure 3B:
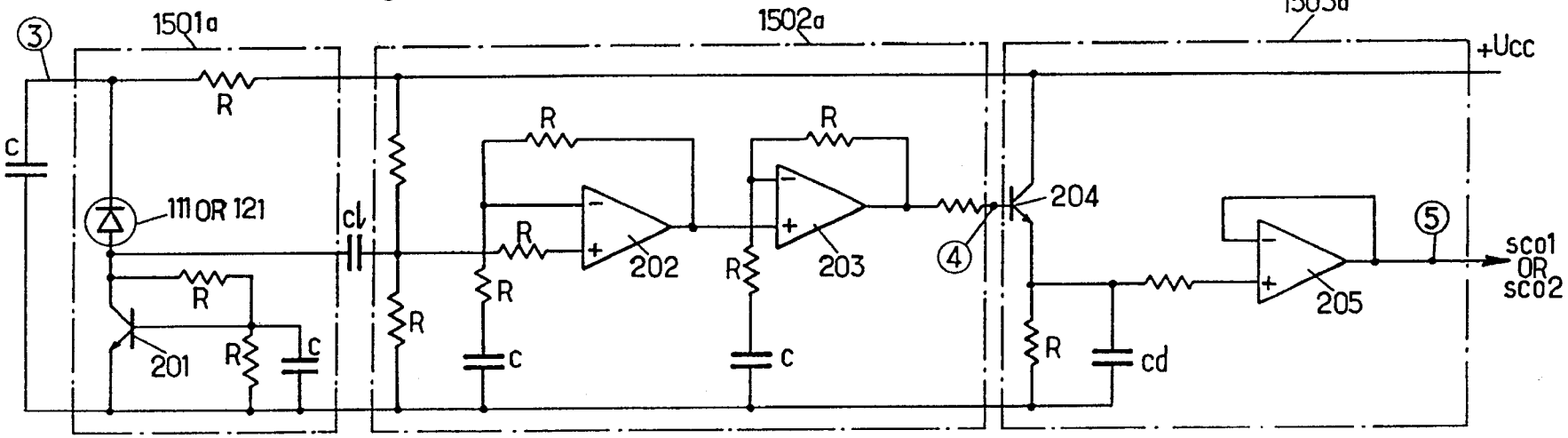
Figure 3C:
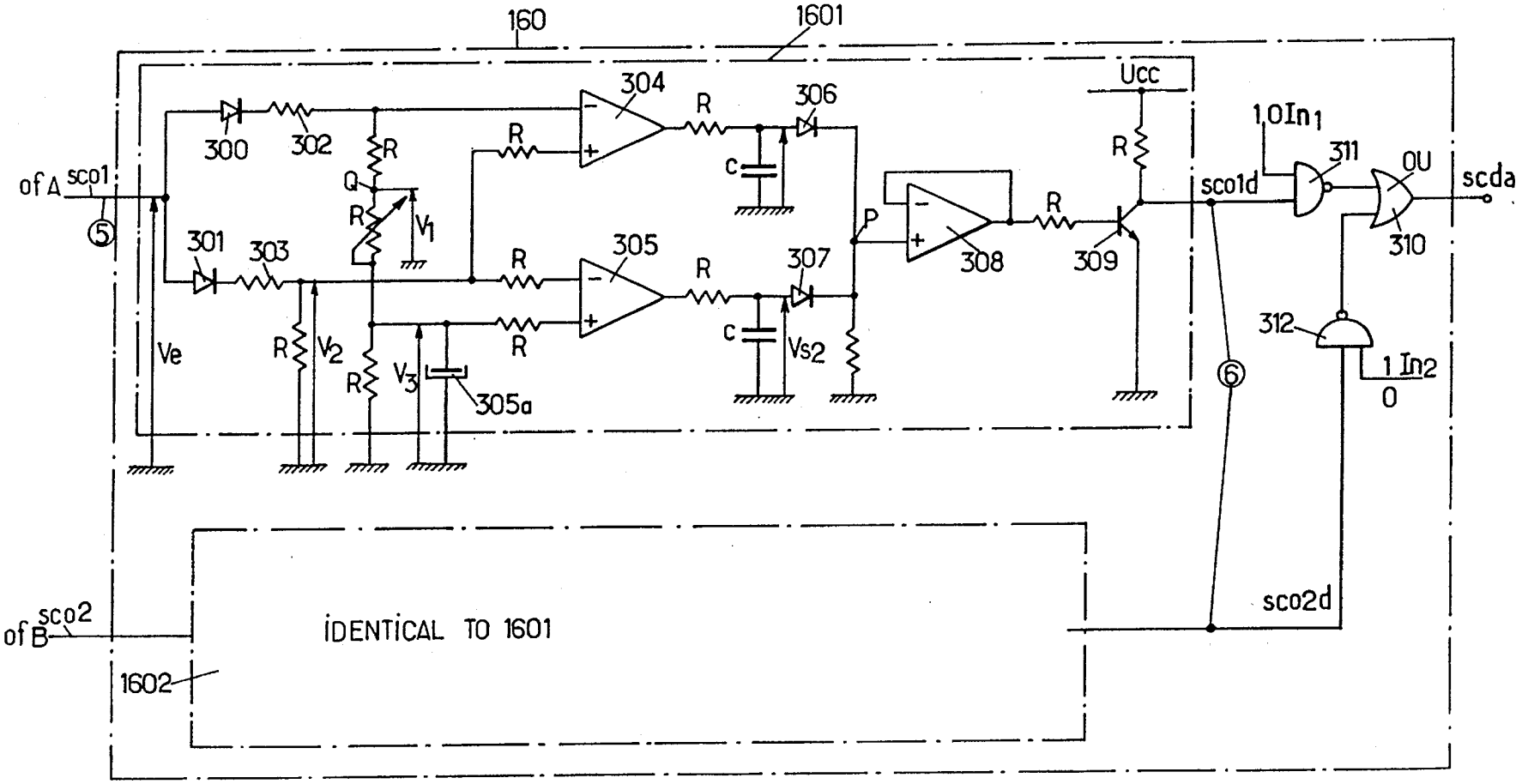
Figures 1, 3D:
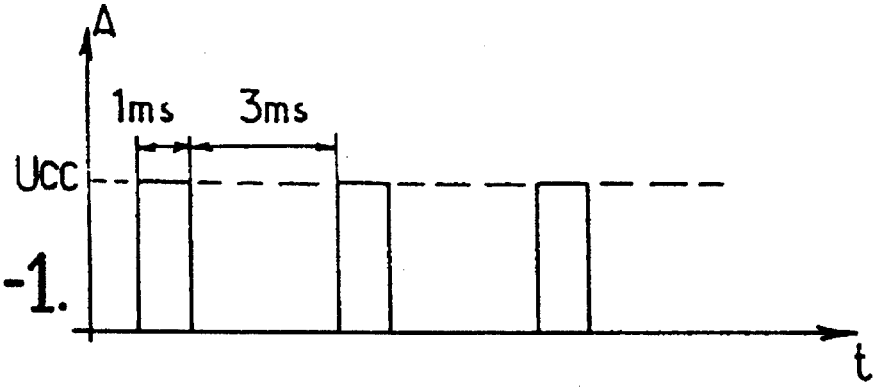
Figures 2, 3D:
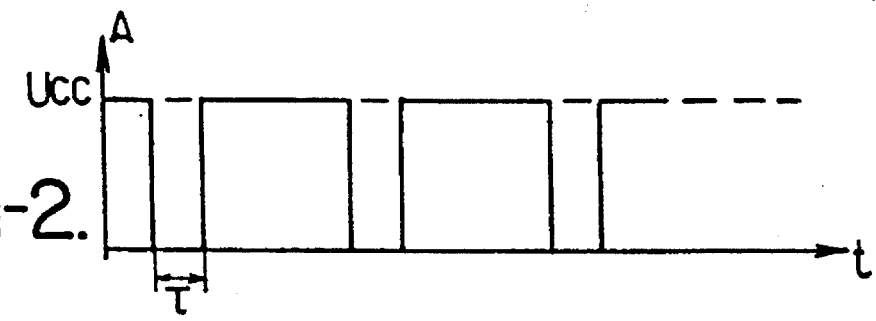
Figures 3, 3D:
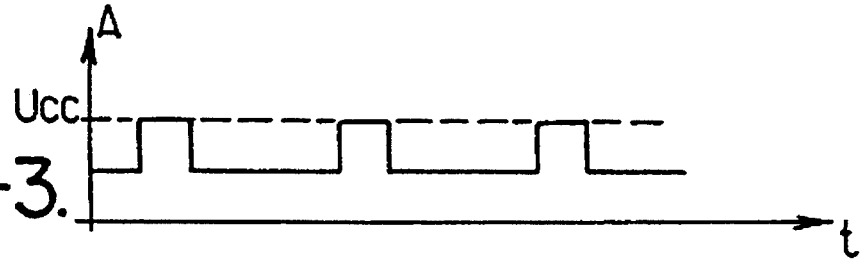

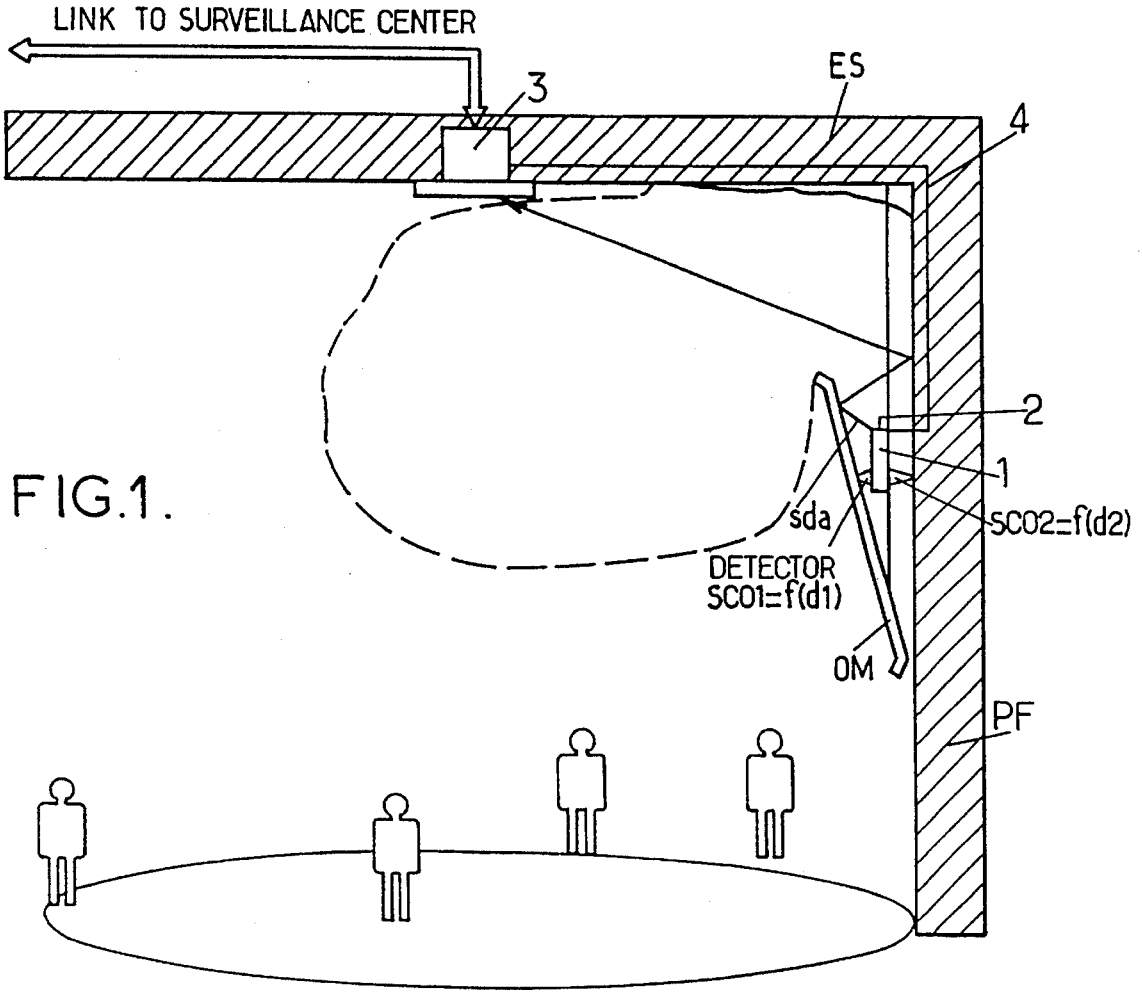
FIG.1.
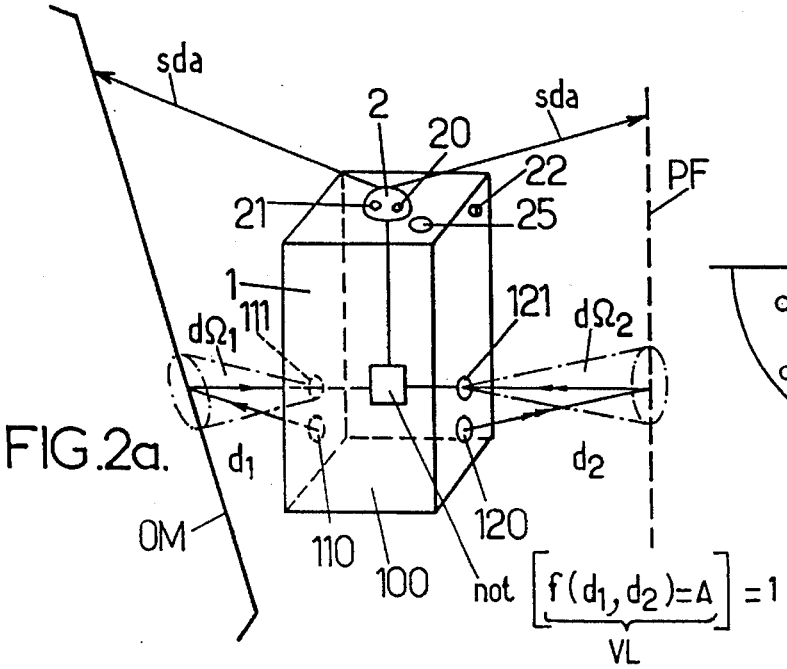
FIG.2a.
FIG.2c.
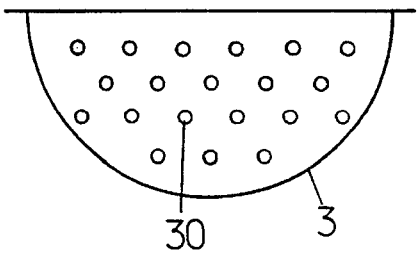

Figures 3, 3D, 4:
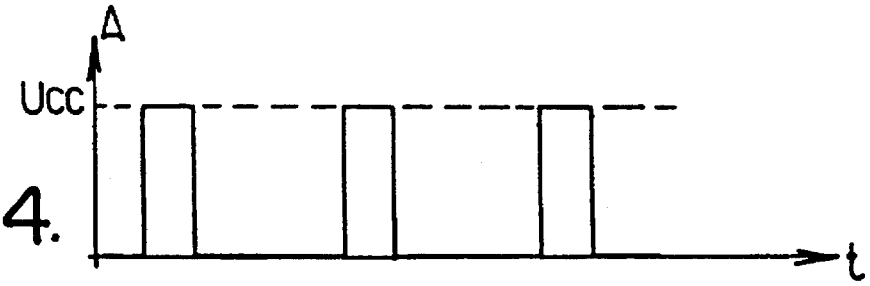

FIG. 4a.
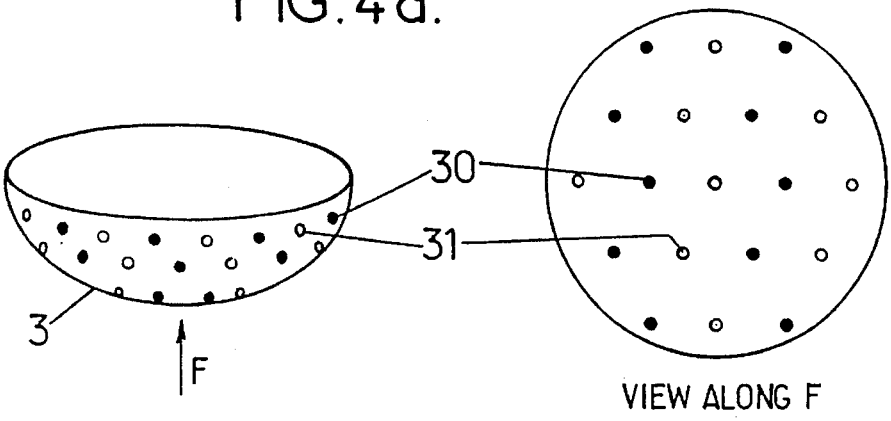
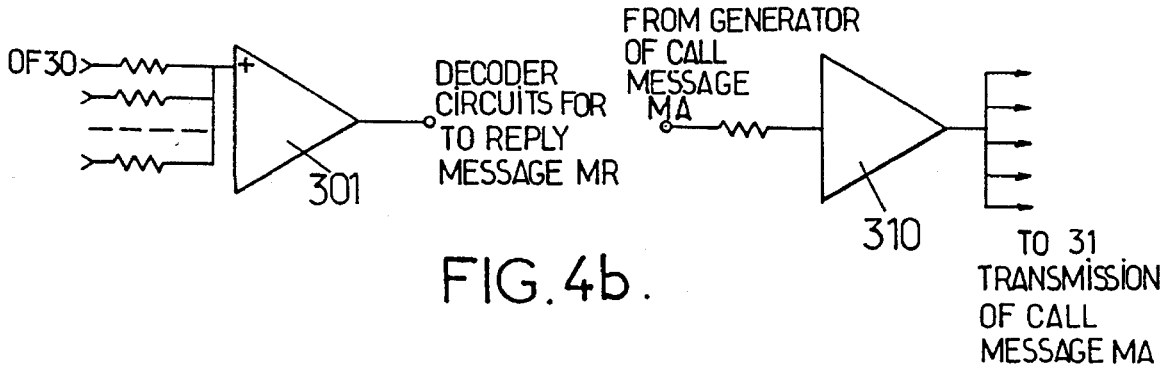
FIG. 4b.
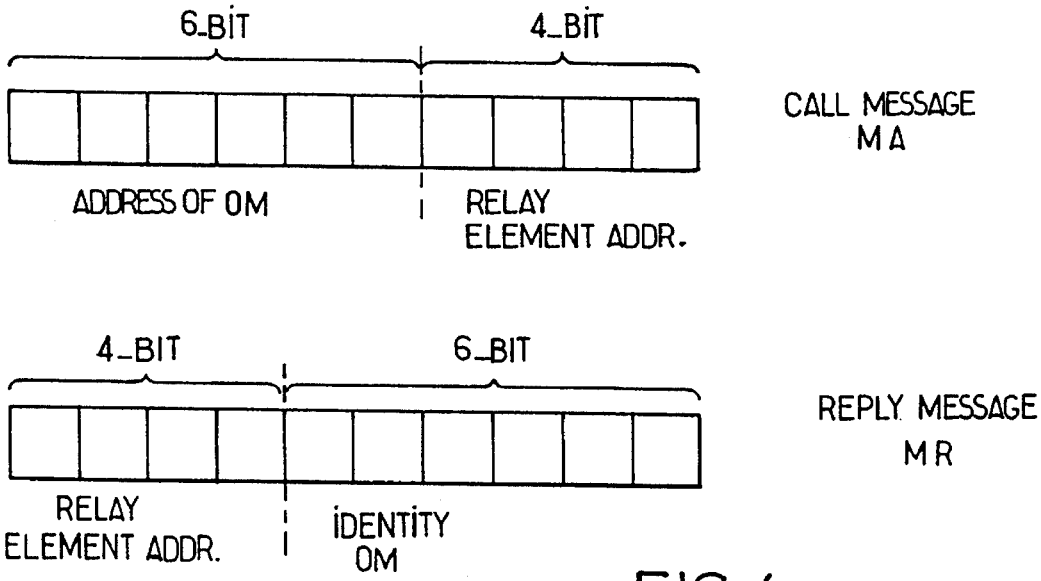
FIG. 4c.

SYSTEM FOR SURVEILLANCE OF A FIXED OR MOVABLE OBJECT

The present invention relates to a system for surveillance of a mobile or movable object.

The surveillance of mobile or movable objects, such as works of art, for example, presents the difficult problem of maintaining maximum surveillance security while allowing normal accessibility to such objects for exhibition purposes.

At present, works of art are put under surveillance either by surveillance of the perimeter of the premises in which they are housed, using perimeter or volume protection systems such as intruder surveillance radars whenever the exhibition is interrupted or terminated, or by mechanical or electromechanical protection means of which the most reliable go as far as denying physical access, so that visitors to an exhibition are physically separated by means of a transparent partition that is considered to be unbreakable.

All too often, this gives rise to constraints or servitudes that go firstly against the appearance of the protected work of art such that the honest spectator is thwarted artistically, and secondly against the well-understood need for economy in the protection of the corresponding artistic heritage, since it is not possible for every work to benefit from such protection independently of its artistic and/or market value.

In contrast an object of the present invention is to provide a surveillance system for a mobile or movable object enabling maximum security to be provided for minimum servitude and applicable to any work of art or mobile or movable object subjected to the system.

Another object of the present invention is to provide a surveillance system for a mobile or movable object suitable for providing dedicated surveillance of one or more works of art or mobile or movable objects in a set of works of art or mobile or movable objects in a collection.

Finally, another object of the present invention is to implement a surveillance system for a mobile or movable object making it possible simultaneously to obtain a high degree of operating independence, very great flexibility in use, and maximum security in so far as the surveillance proper of one or more mobile or movable objects may be associated with surveillance or monitoring of the environment of said objects, at least in part.

According to the present invention, a system for surveillance of a mobile or movable object placed in a surveillance enclosure is remarkable in that it comprises a transmitter/receiver device for transmitting and receiving first and second object-monitoring signals, the first object-monitoring signal serving to monitor the presence of the object and the second object-monitoring signal serving to monitor the position of the object. A device for transmitting an alarm-triggering signal is provided, said device receiving the first and second object-monitoring signals and enabling an alarm-triggering signal to be transmitted conditionally on the basis of a logical and/or an analog combination of the first and second object-monitoring signals.

The system for surveillance of a mobile or movable object in accordance with the invention is applicable to the surveillance of art objects exposed in museums or in temporary exhibitions, and more generally to any objects of value or valuables placed within a perimeter that may optionally itself be protected.

A more detailed description of the system of the present invention is given below in the following description and with reference to the accompanying drawings, in which:

FIG. 1 is a general overall view of the system of the present invention for surveillance of a mobile or movable object;

FIG. 2*a* shows a detector specifically adapted to implementing the surveillance system of the present invention;

FIG. 2*b* is a block diagram of the electronic circuits suitable for use with a detector as shown in FIG. 2*a;*

FIG. 2*c* is a non-limiting example of an alarm-triggering relay element disposed in the surveillance enclosure;

FIG. 3*a* is a circuit diagram of a particular embodiment of a signal transmitter suitable for implementing the electronic circuits shown in FIG. 2*b;*

FIG. 3*b* is a circuit diagram of an embodiment of a demodulation path as shown in FIG. 2*b* and serving to deliver either the first or the second object-monitoring signal;

FIG. 3*c* is a circuit diagram of an advantageous embodiment of a cross-correlation circuit for the first and second object-monitoring signals, for the purpose of conditionally transmitting an alarm signal;

FIG. 3*d* is a timing diagram for signals taken from various test points in FIGS. 3*a,* 3*b,* and 3*c;*

FIG. 4*a* shows a variant embodiment of the alarm transmission relay element shown in FIG. 2*c;*

FIG. 4*b* shows a detail of the electronic circuit in the relay element shown in FIG. 4*a;*

Figures 3, 3D, 4, 5:
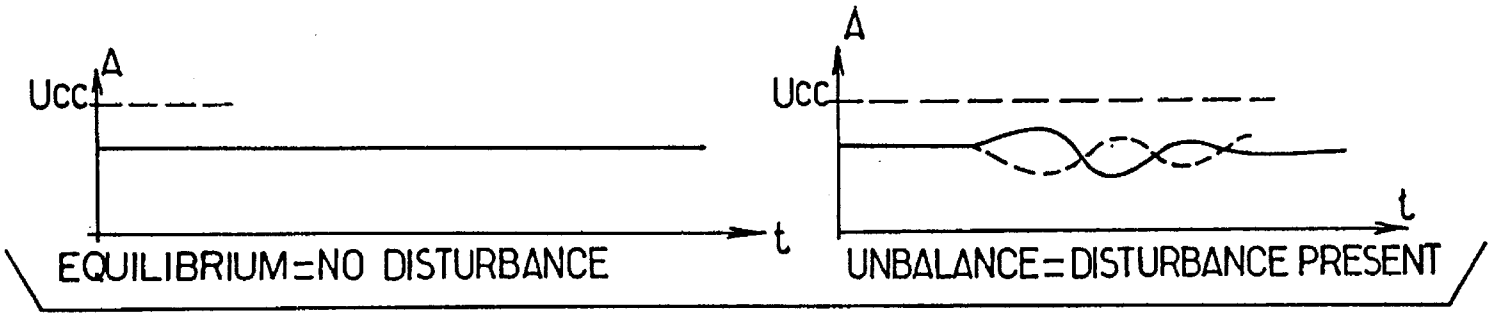
Figures 3, 3D, 4, 5, 6:
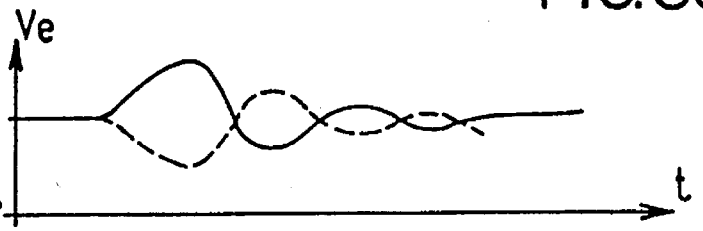
Figures 3, 3D, 4, 5, 6, 7:
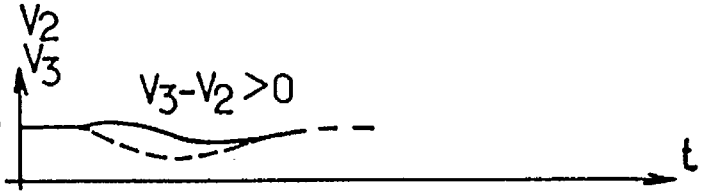
Figures 3, 3D, 4, 5, 6, 7, 8:
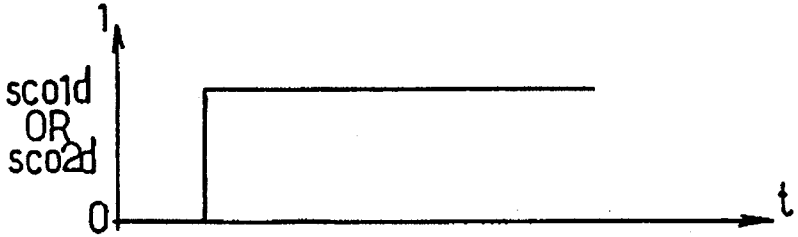
Figure 4D:
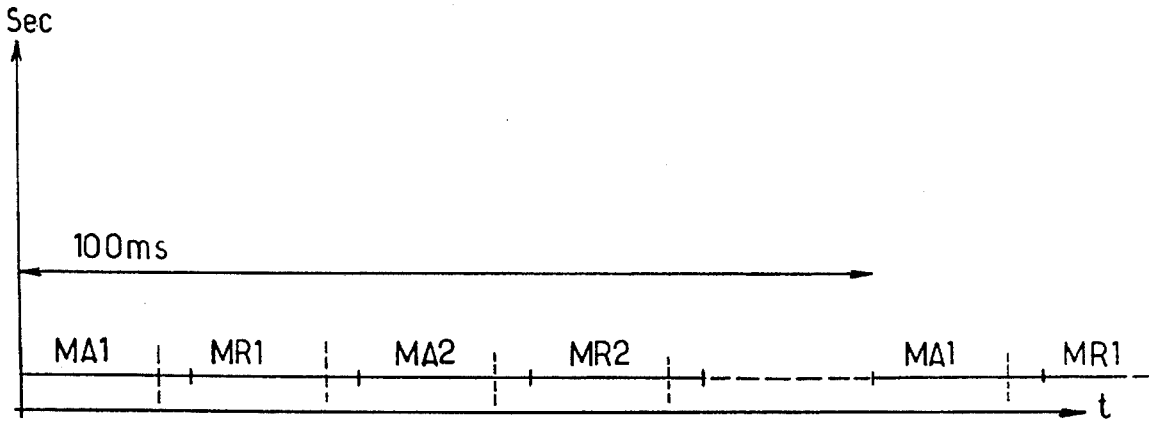
Figure 5:
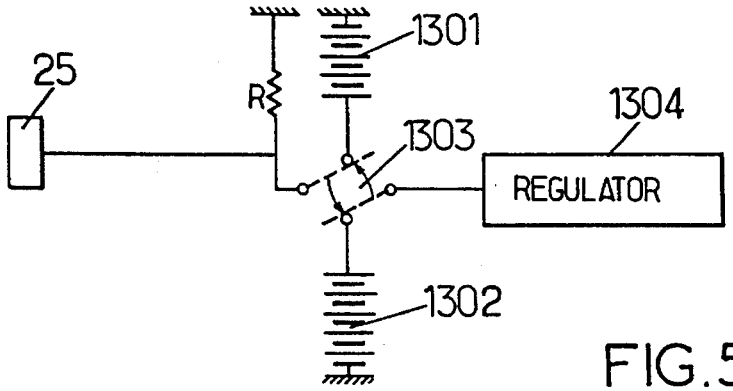
Figure 6A:
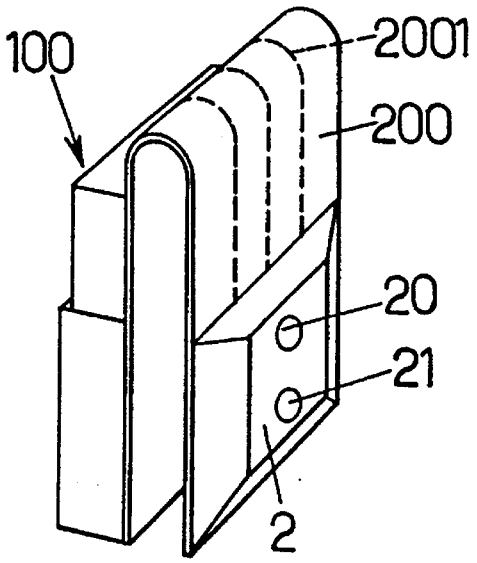
Figure 6B:
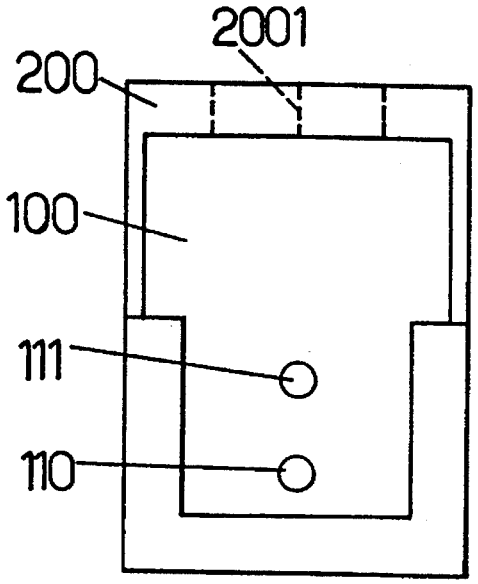
Figure 6C:
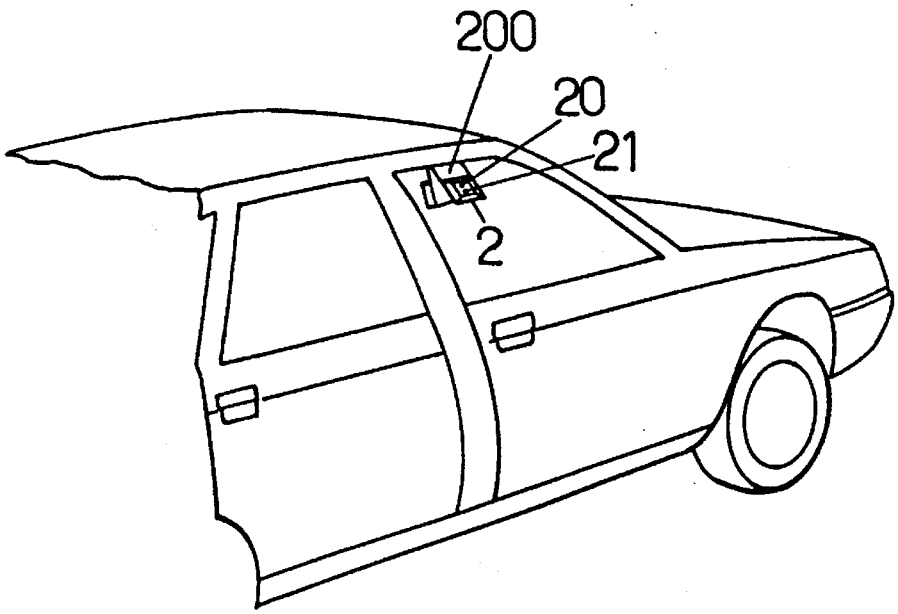

FIG. 4*c* shows a call message MA and a reply message MR respectively transmitted and received by the relay element shown in FIG. 4*a* by means of a detector such as that shown in FIG. 2*a,* for example;

FIG. 4*d* shows a transmission sequence of call messages MAi and of corresponding reply messages MRi;

FIG. 5 shows a detail of an advantageous embodiment of a detector as shown in FIG. 2*a;* and FIG. 6 shows a particularly advantageous application of the system for surveillance of the invention as applied to mobile objects such as self-propelled vehicles.

A more detailed description of a system for surveillance of a mobile or movable object in accordance with the present invention is now given with reference to FIG. 1.

In FIG. 1, the system for surveillance of a mobile or movable object of the invention comprises a transmitter/receiver circuit 1 for transmitting and receiving first and second object-monitoring signals, respectively referenced sco1 and sco2. The first object-monitoring signal serves to monitor the presence of the object while the second object-monitoring signal serves to monitor the position of the object.

A transmission circuit 2 is also provided for transmitting an alarm-triggering signal, said transmission circuit 2 receiving the first and second object-monitoring signals sco1 and sco2 and enabling an a alarm-triggering signal to be transmitted conditionally on the basis of a logical and/or analog combination of the above-mentioned first and second object-monitoring signals sco1 and sco2.

In FIG. 1, it will be observed that the mobile or movable object is referenced OM, whereas the enclosure under surveillance is shown as being a hall in a museum, for example, represented by its ceiling and by one of its walls, the mobile or movable object being represented diagrammatically by an exposed painting, e.g. suspended from the ceiling.

According to a particularly advantageous characteristic of the surveillance system of the present invention, the first object-monitoring signal sco1 is a function of the distance d1 between the mobile or movable object OM under surveillance and the active portions of the transmitter/receiver circuit 1.

According to another particularly advantageous characteristic of the system for surveillance of a mobile or movable object of the invention, the second object-monitoring signal is a function of the distance d2 between the mobile or movable object under surveillance and a fixed plane of the surveillance enclosure that is referenced PF in FIG. 1, which fixed plane is taken as being a reference plane. Naturally, the fixed plane could be constituted as shown in FIG. 1 by one of the walls of the exhibition hall.

According to another particularly advantageous characteristic of the surveillance system of the present invention, conditional transmission of the alarm-triggering signal which signal is referenced sda in FIG. 1, is implemented on the basis of a logical and/or analog combination of the first and second object-monitoring signals sco1 and sco2 as specified by the following equation:

$$\text{NOT}[f(d1,d2)=A]=1 \quad (1)$$

In the above equation, it may be observed that f(d1,d2) designates a function of the distance values d1 and d2 relating to the mobile or movable object OM under surveillance, and the term NOT indicates that there is no change or difference in the value of said function relative to a reference value A for the mobile or movable object OM under consideration, for which value A the object is considered to be safe.

From the above-given equation, it can be seen that if the value of the function f(d1,d2) is in fact equal to A, i.e. the determined reference value for the mobile or movable object OM under consideration, which object is considered to be safe under such circumstances, then the logical value of the above-specifies equality between f(d1,d2) and A is considered as taking the value 1, and naturally the logical function NOT then converts that value to 0, such that the alarm-triggering signal sda is not transmitted.

In contrast, whenever the value of the function f(d1,d2) is not equal to the above-specified value A, then the logic value of the above-specified equality becomes equal to 0 such that the logic NOT function converts it to 1, in which case the difference or variation in said function relative to the constant reference value A becomes representative of a disturbance in the safe situation of the mobile or movable object OM under surveillance. The alarm-triggering signal sda is then transmitted.

It may-be observed, in particular, that the function f(d1, d2)=A may be a logic function of the distance variables d1 and d2 taken as logical variables (or as digital variables) and/or and an arithmetic function of the distance variables d1 and d2 taken as analog variables.

By way of non-limiting example, it is specified that the logic function of the distance variables d1 and d2 may be constituted, for example, by a logic AND type function of the logic variables d1 and d2, whereas the arithmetic function of the distance variables d1 and d2 may be implemented, for example by comparing distance values, i.e. by comparing an amplitude level of each of the first and second object-monitoring signals sco1 and sco2 relative to determined threshold values, as described in greater detail in the description below.

By way of non-limiting example, it may be observed that the circuit 2 for transmitting an alarm-triggering signal may either be implemented by a self-contained system that triggers an audible alarm, such as a buzzer for example, or preferably but without being limiting, it may be a circuit for transmitting an alarm-triggering signal such as the trigger signal sda shown in FIG. 1. In the first case, the alarm-triggering signal sda is constituted by the sound signal given off by the buzzer.

In contrast, in the second case, and in preferred manner, the surveillance system of the present invention further includes a relay element 3 for the alarm-triggering signal, which element is disposed on the surveillance enclosure. The relay element 3 is preferably placed in the ceiling of the exhibition hall, for example. The alarm trigger relay element 3 is designed to receive the alarm-triggering signal sda in the event that said signal is not constituted by a sound signal given off by a buzzer. The alarm triggering relay alarm 3 is then connected to a surveillance center by means of a bus type link, for example, as explained in greater detail below in the description.

With reference to FIG. 2*a*, there follows a more detailed description of the organization of the transmitter/receiver circuit 1 and of the alarm-triggering signal transmitter circuit 2 as described above with reference to FIG. 1.

In above-mentioned FIG. 2*a*, the transmitter/receiver circuit 1 is constituted by transmitter/receiver first and second transducers 110, 111, and 120, 121 respectively. A transmission third transducer 2 is provided for the purpose of embodying the alarm-triggering signal transmitter circuit 2, as described below in the description.

For example, the first, second, and third transducers may be electromagnetic wave transducers or ultrasound wave transducers mounted in a box 100 constituting a detector for surveillance of the mobile or movable object OM, said detector, or a plurality of such detectors, each of which is associated with a different mobile or movable object under surveillance, co-operates with the alarm triggering relay element 3 so as to constitute the surveillance system of the present invention.

In general, and as shown in FIG. 2*a*, the transmitter/receiver first and second transducers 110, 111 and 120, 121, respectively, serve to generate and receive electromagnetic or ultrasound waves that are amplitude modulated with given duty ratio and modulation frequency. As shown in the above-mentioned figure, electromagnetic or ultrasound waves are transmitted and received by each transducer over a surveillance solid angle which, for the first transducer is directed towards the mobile or movable object OM under surveillance, the solid angle being written dΩ1 and being proportional to the distance d1, whereas for the second transducer, the solid angle dΩ2 is directed towards the fixed plane PF of the surveillance enclosure that is taken as a reference, and is proportional to the distance d2. It may be observed that the transmitter/receiver first and second transducers may be implemented respectively by a transmitter diode 110 with a receiver diode 111, and by a transmitter diode 120 with a receiver diode 121. These diodes may then perform transmission and reception in the infrared region of the electromagnetic spectrum, for example.

Thus, as shown in FIG. 2*a*, the transmitter/receiver first and second transducers are constituted by the transmitter diodes 110 and 120 placed respectively on first faces of a box 100 constituting the detector for surveillance of the mobile or movable object OM, in association with the receiver diodes 111 and 121 disposed respectively on the same first and second faces of the box 100. The above-mentioned transmission and reception diodes constitute the transmitter/receiver first and second transducers and are thus disposed on two oppositely-directed faces of the box so as to point their respective first and second transmitted beams respectively towards the mobile or movable object OM and towards the fixed plane PF. Naturally, each transmitter diode 110 or 120 is connected to an electronic circuit that enables infrared transmission to be generated over analogous solid angles, while the receiver diodes 111 or 121 are connected to an electronic circuit serving, in particular, to perform the function described by above-specified equation (1) so as to enable an alarm-triggering signal sda to be transmitted as mentioned above.

It may also be observed that the transmitter and receiver diodes 110, 111 and 120, 121 may be mounted in respective housings formed in the faces of the box 100 so as to reduce the risk of either of the receiver diodes 111 or 121 being directly excited by the beam transmitted by the corresponding transmitter diode 110 or 120. In this respect, it may be observed that the powers emitted by each diode are limited to a few milliwatts.

A more detailed description of the above-mentioned electronic circuits contained in the box 100 and constituting the detector of the present invention is now given with reference to FIG. 2*b*.

In FIG. 2*b*, the box 100 forming the surveillance detector advantageously comprises an electricity power supply circuit 130 for the first, second, and third transducers, said circuit 130 enabling a power supply voltage written Ucc to be applied to all of the electronic circuits.

The box also contains a circuit 140 for generating a transmission signal that is pulse modulated at a given duty ratio and repetition frequency. This transmission signal may be generated, for example, by an oscillator 1401 which delivers firstly a synchronizing signal SYNCHRO delivered to all of the electronic circuits, and the transmission signal proper for modulating the emission of infrared by the transmitter diode 110 and 120. The transmitter signal is delivered to the transmitter diode constituting the first or second transmitter/receiver transducer 110 or 120 respectively via a circuit 1402 that serves to regulate the power and the current flowing through the transmitter diodes 110 and 120.

In addition, as shown in FIG. 2*b*, the above-mentioned electronic circuits include a demodulator circuit 150 comprising first and second demodulation paths A and B. Each demodulation path A and B is connected to a respective receiver diode 111 or 121 of the corresponding transmitter/receiver first or second transducer.

Each demodulation path A, B comprises at least one envelope detector referenced 1503*a* or 1503*b* serving to detect the envelope of the signal delivered by the receiver diode of the corresponding transmitter/receiver first or second transducer.

As shown in FIG. 2*b*, it may be observed, for example, that each receiver diode 111 and 121 respectively of the first and the second transducer, is connected to the corresponding demodulation path A or B which may then comprise, in succession: a current-to-voltage converter referenced 1501*a* or 1501*b*; a matching circuit referenced 1502*a* or 1502*b*; and the above-mentioned enveloped detector 1503*a* or 1503*b*.

It may be observed that the envelope detector in each of the first and second demodulation paths A and B respectively delivers a signal constituting the first or the second object-monitoring signal sco1 or sco2 respectively.

Furthermore, as shown in FIG. 2*b*, the box 100 also includes a cross-correlation circuit 160 that receives the first and second object-monitoring signals and that serves conditionally to transmit a signal scda that causes an alarm to be triggered. Naturally, it will be observed that above-mentioned circuit 160 serves, in fact, to perform the function given by above-specified equation (1) to trigger or not trigger the above-mentioned alarm-triggering signal sda.

When the above-specified condition is satisfied, the alarm triggering control signal scda is issued by the cross-correlation circuit 160 to the circuit 2 for transmitting the alarm-triggering signal sda as shown in FIG. 2*b*, i.e. to the transmission third transducer 2. As shown in FIG. 2*b*, it may be observed that it includes at least one diode 20 for transmitting towards the alarm triggering relay element 3 an electromagnetic or an ultrasound wave that may be coded for example, and that constitutes the alarm-triggering signal sda.

As also shown in FIG. 2*b*, it may be observed that the box 100 can be provided with an alarm triggering indicator circuit 26 which receives the alarm triggering control signal scda, said triggering indicator circuit 26 being connected, for example, to a light emitting diode (LED) 27 that operates by flashing, and to a buzzer 28, for example, and that is also provided with a reset element 29 marked RESET. It may also be observed that the alarm triggering indicator circuit 26 and the transmission third transducer may also receive, in parallel with the alarm triggering control signal scda, a technical alarm control signal scat generated by the power supply circuit 130 in the manner described below in the description.

Finally, it may be observed that the encoded electromagnetic or ultrasound wave transmitted by the third transmission 2, i.e. by the corresponding transmitter diode 20, or by the piezoelectric transducer in the event that an ultrasound wave is used, may be encoded in such a manner as to transmit a code representative of the mobile or movable object or of its address.

Finally, as shown in FIG. 2*c*, and in particularly advantageous manner, the trigger relay element 3 may comprise at least one of a plurality of receiver diodes referenced 30. The receiver diodes 30 are advantageously distributed over a spherical or hemispherical cap type surface so as to enable the alarm-triggering signal sda to be received over an angle of 180° in elevation and in azimuth.

It will naturally be understood that under such circumstances the receiver diodes 30 in said plurality are interconnected in such a manner as to be put in parallel, e.g. via impedance matching operational amplifiers.

A more detailed description of the pulse modulated transmission signal generator circuit 140, of the demodulator circuit 150, and of the circuit 160 for cross-correlating the first and second object-monitoring signals is given with reference to corresponding FIGS. 3*a* to 3*d*.

In FIG. 3*a*, there can be seen the pulse modulated transmission signal generator circuit 140, or at least a portion thereof. In FIG. 3*a*, the current regulator circuit is not shown, but the power circuit and the oscillator circuit are shown and comprise, for example, two NAND type gates 1042*a* and 1042*b* connected in cascade and designed to constitute an astable oscillator whose duty ratio is made asymmetrical by a diode 1042*c* and whose frequency of oscillation is set by the resistance R and the capacitance of capacitor 1042*d*, which signal is then applied to two power transistors in a Darlington type circuit, said transistors being referenced 1042*e* and 1042*f*. The collector electrode of the output transistor 1042*f* is loaded by the transmitter diode 110 or by the diode 120, for example. Timing diagrams for the signals that correspond to test points 1 and 2 in FIG. 3*a* are labelled 1 and 2 respectively in FIG. 3*d*. It may be observed that for a signal delivered by the oscillator and that comprises, for example, a pulse having a duration of 1 millisecond and a rest period of 3 milliseconds, the transmitter diode 110 or 120 is caused to conduct during the corresponding pulse duration, which is written t.

In FIG. 3*b*, there can be seen one of the demodulation paths A or B constituting the demodulator circuit 150, and in particular there can be seen the elements 1501*a*, 1502*a*, and 1503*a* of FIG. 2*b*. It will naturally be observed that the demodulation path B can be implemented by elements given references 1501*b*, 1502*b*, and 1503*b* that are identical to the corresponding elements in demodulation path A.

As shown in FIG. 3*b*, receiver diode 111 or 121 is connected to the collector electrode of a common emitter connected transistor 201 whose base circuit is biased by resistors R and by a capacitor C. This circuit serves to provide automatic correction for luminosity so as to take account, where appropriate, of the residual voltage delivered by either of the above-mentioned receiver diodes due to ambient lighting. The output of the current to voltage converter circuit 1501*a*, i.e. the collector electrode of transistor 201, is connected via a coupling capacitor C1 to the matching circuit 1502*a* which may advantageously be constituted (as shown in FIG. 3*b* ) by two operational amplifiers 202 and 203 connected in cascade, said amplifiers being normally biased by corresponding circuits having resistors R and capacitors C.

Finally, the matching circuit 1502*a*, i.e. the output from the second amplifier 203, is connected to the envelope detector circuit 1503*a*. This circuit comprises an emitter follower input transistor 204 serving to constitute an impedance matching and isolating stage, which transistor and in particular the emitter resistor R thereof having a detector capacitor cd connected in parallel therewith serves to detect the envelope of signals as delivered by the matching circuit 1502*a* and to connect them to a follower type amplifier circuit 205 which delivers the object-monitoring signal sco1 or sco2 depending on whether the demodulation path is A or B respectively.

Timing diagrams of the signals taken from test points 4 and 5 of FIG. 3*b* are given in FIG. 3*d* under corresponding labels 4 and 5. It may be observed that the signal provided by test point 5 constitutes the first (or second) object-monitoring signal sco1 (or sco2), and that this signal corresponds either to a DC voltage of a value that is steady at equilibrium, i.e. in the absence of any disturbances that may be generated on the mobile or movable object OM itself if the first object-monitoring signal is involved or by displacing said object relative to the reference plane PF if an unbalance occurs, i.e. if there is a disturbance relating to the second object-monitoring signal sco2. These various equilibrium or unbalanced states are represented under label 5 without prejudice to the real waveform that a disturbance may cause, where a disturbance is represented merely by a difference relative to the above-mentioned equilibrium state.

The first and second object-monitoring signals sco1 and sco2 are then delivered to the cross-correlation circuit 160 which is described below with reference to FIG. 3*c*.

In FIG. 3*c*, there can be seen a non-limiting embodiment of a cross-correlation circuit that serves, in fact, to implement a logical and/or analog combination of the first and second object-monitoring signals sco1 and sco2 as a function of the situations that arise in use of the surveillance system of the present invention, and in particular in use of the detector circuit thereof.

In above-mentioned FIG. 3*c*, it can be seen that the cross-correlation circuit 160 may advantageously comprise first and second window comparators referenced 1601 and 1602 respectively. Each window comparator receives the corresponding one of the signals sco1 and sco2 as delivered by the demodulation path A and by the demodulation path B. The window comparators 1601 and 1602 may be identical, and therefore only the window comparator 1601 is described.

This comparator comprises two operational amplifiers 304 and 305 connected in parallel, having their input circuits connected to the corresponding signal sco1 via respective diodes 300 and 301 and bias circuits comprising resistors R and capacitors C. The outputs from the operational amplifiers 304 and 305 are connected together via a resistance and capacitance circuit RC and via respective diodes 306 and 307 to a common point P, which common point is itself connected to the positive input of an operational amplifier 308 operating as an amplifier with its output looped back to its negative input. The output of the amplifier 308 is connected to an output stage constituted by a common emitter transistor 309. The signal scold corresponding to the first detected object-monitoring signal is delivered by the corresponding first window comparator circuit 1601. The same applies to the second detected object-monitoring signal sco2d delivered by the window comparator 1602.

The window comparator 1601 or 1602 then operates as follows.

At equilibrium, i.e. in the situation of chart labelled 5 in FIG. 3*d*, the following equations apply:

$$v1>v2=k\times ve, \text{ which implies } vs1=0$$

$$v2=k\times ve>v3, \text{ which implies } vs2=0$$

It will be understood that ve represents the amplitude of the signal input to the window comparator 1601, v1 represents the voltage value defined by the potentiometer ratio k at point Q in FIG. 3*c*, v2 represents the input voltage value applied to the negative terminal of the second operational amplifier 305, and v3 represents the value of the voltage stored on capacitor 305*a* connected in parellel with the positive input of operational amplifier 305.

In contrast, in the presence of disturbances, as shown by the chart labelled 5 in FIG. 3*d* or labelled 6 in the same figure, where such a disturbance necessarily gives rise to a reduction in the input voltage ve to the comparator under consideration, the voltage v3 across the terminals of the capacitor 305*a* becomes >v2 because of the presence of the above-mentioned capacitor, thus having the effect of triggering operational amplifier 305 which is connected as a comparator, with the voltage vs2 then switching to a value that is not equal to 0, i.e. to logic value 1. From point P, the amplifier 308 transmits the corresponding amplified signal via output transistor 309, which transistor delivers the corresponding detected object-monitoring signal sco1d or sco2d.

Finally, it will be observed that the cross-correlation circuit 160 further includes a connection of logic circuits constituted, for example, by an OR gate 310 and by two AND gates 311 connected to respective ones of the two inputs of above-mentioned OR gate 310, with the AND gates 311 and 312 respectively receiving firstly the first detected object-monitoring signal scold and the second detected object-monitoring signal sco2d, and secondly first and second inhibit signals referenced In1 and In2, thus enabling the OR gate 310 to deliver the above-mentioned alarm triggering control signal scda.

It will thus be observed that by a logical combination of the inhibit signals In1 and/or In2, it is possible to control, i.e. to cross-correlate the first and second object-monitoring signals sco1 and sco2 respectively, thus making it possible to adapt the operation of the detector 100 of the present invention as a function of conditions of use, as described below in the present description.

It will naturally be observed that the value selected for the potentiometer ratio k at point Q in each of the comparator circuits 1601 and 1602 also serves to match detection sensitivity to the conditions of use of the detector circuit, and finally to the mobile or movable object OM under surveillance and to the conditions under which said object is exhibited or detained.

It will naturally be observed that other logical combinations may be performed merely by altering the configuration of the logic circuit constituted by the gates 310 and 311 or 312.

Finally, it will be observed that in order to provide maximum surveillance security, as shown in FIG. 1, the connection between the third transmission transducer 2 and the trigger relay element 3 may be backed up by an optical fiber link 4, for example. To this end, it may be observed that an optical fiber connector port 22 is present on the corresponding face of the detector box 100 shown in FIG. 3*a*. The optical fiber 4 may advantageously be embedded in the corresponding wall and ceiling.

The presence of a physical link implemented by an optical fiber naturally makes it possible to increase the security of the surveillance of mobile or movable objects, but it suffers from the drawback of an additional constraint, namely that of installing the corresponding physical circuits and of the work thus required in exhibition halls or storage facilities for mobile or movable objects under surveillance.

In order to eliminate the above-specified drawback, it is advantageous to omit the above-mentioned optical fiber link 4 and to replace it with the dispositions described below.

In accordance with a particularly advantageous aspect of the system of the present invention, the trigger relay element 3 may include at least one transmitter receiver element suitable for periodically sending an encoded call message MA to each of a plurality of third transmission transducers 2. Each of the third transmission transducers 2 is itself then formed by a transponder 20, 21 connected to the transmitter circuit of the third transmission transducer 2, which transponder serves, in fact, to generate an encoded reply message MA in response to the call message MA, which response message indicates that the mobile or movable object under surveillance is safely present.

As shown in FIG. 2*b*, the presence of a transmitter diode 20 can be observed that serves to generate the alarm-triggering signal sda, and there can also be seen a receiver diode 21 that serves to receive the call messages MA, in the manner described below. Naturally, under such conditions, it will be observed that the alarm-triggering signal sda can advantageously be constituted by the absence of a reply message under specified conditions described below. In such a case, the alarm-triggering signal is constituted for a given mobile or movable object by the absence of a plurality M of consecutive encoded reply messages MR.

One such way of operating the system of the present invention is now described with reference to FIGS. 4*a*, 4*b*, and 4*c*.

FIG. 4*a* shows an advantageous embodiment of the alarm-transmitting relay element 3 in which a plurality of receiver diodes 30 and of transmitter diodes 31 are distributed over a spherical cap, in the manner described above.

Naturally, as shown in FIG. 4*b*, all of the receiver diodes 30 are connected in parallel via an operational amplifier, e.g. with all of the transmitter diodes 31 themselves being connected in parallel by means of an operational amplifier 310. A call message MA is transmitted and the corresponding reply message MR is received under such circumstances by all of the corresponding parallel-connected diodes, as described with reference to FIGS. 4*c* and 4*d*.

FIG. 4*c* shows firstly a call message MA and secondly a reply message MR. The call message may be constituted, for example, by a message encoded on 6 bits that represent the address of the object OM, followed by an identification flag encoded on 4 bits and identifying the relay element 3 that generated the call message MA. By way of non-limiting example, the more significant bits serve to encode the address of the mobile or movable object OM, while the less significant bits serve, on the contrary, to encode the identity of the relay element that generated the call message MA.

It will thus be observed that the call messages and the reply messages are subdivided into two portions each, which portions serve to specify both the address of the mobile or movable object and the address or the identity of the relay element 3, thus making very flexible utilization of the detectors and the surveillance system of the present invention possible, firstly because it is possible not only to monitor a plurality of mobile or movable objects OM by means of a single relay element 3 for transmitting the alarm signal having a determined address, and secondly because it is possible to use a plurality of relay elements 3 having different addresses for monitoring a very large museum hall, for example, or a region in which mobile or movable objects are stored, i.e. a region that may be subdivided into surveillance zones, with each zone being covered by a relay element 3 of corresponding address.

Finally, it may be observed that the encoding of call messages MA and of reply messages MR can then be implemented using conventional techniques such as PPM or RC5, or the like.

Naturally it will be observed that electronic circuits for encoding the call messages MA and the reply messages MR are not described since they naturally correspond to circuits that are conventional in this type of operation.

FIG. 4*d* shows a sequence of successive call messages MA being transmitted and of corresponding successive reply messages MR being received as transmitted and received respectively via an alarm transmission relay element 3, for example. It will naturally be understood that the corresponding elements 3 can be used for sequentially transmitting different call messages MA1, MAi and for immediately receiving the various corresponding reply messages MR1, MRi. For a number N of mobile or movable objects under surveillance in association with a given relay element 3, the period during which call messages are transmitted sequentially may, for example, have a duration of 100 milliseconds for n=32 mobile or movable objects.

When a number M of successive reply messages MRi have not been received for a given mobile or movable object of specified order i (which number M may be equal to 2 or 3, for example), the absence of such successive messages being received is then considered as constituting an alarm-triggering signal for the relay element 3 that transmits the alarm-triggering signal, and which is suitable for association with a controlling computer, or merely with a surveillance center to which each relay element 3 for transmitting the alarm-triggering signal is connected.

A more detailed description of the electrical power supply circuits of the alarm system of the present invention, and in particular of the detector itself suitable for implementing such a system are given below with reference to FIG. 5.

The power supply circuit 130 as shown in FIG. 2*b* advantageously comprises a first rechargeable battery 1301 and a second rechargeable battery 1302, which batteries are connected via a changeover switch 1303 to a regulator 1304 suitable for delivering the above-mentioned DC power supply voltage Ucc. At the output of the regulator 1304, a low voltage detector circuit 1305 is connected serving firstly to make it possible to switch over the changeover switch 1303 from one rechargeable battery 1301 to the other rechargeable battery 1302, or vice versa, and secondly, on detecting a particular voltage value as delivered by the regulator is below a predetermined threshold value, to make connection with one or other of the above-mentioned batteries. It may be observed that the regulator circuit 1304 is a conventional regulator circuit serving to regulate the current delivered by the storage battery it switches.

The low voltage detector circuit is a threshold comparator circuit that serves, in the event of the voltage delivered by the regulator crossing the threshold value, to generate a switchover control signal for the switch 1303. This circuit is not described in detail since it corresponds to conventional type circuits. In addition, in non-limiting manner, the circuit 1305 for detecting low voltage may be provided with a memory circuit that serves to store a first detection of a low voltage on one of the batteries and also makes it possible to store the value of the voltage detected on the other battery after switchover, and in the event that both stored battery voltage values are less than the threshold value, to generate a technical alarm control signal scat, for example, which signal serves firstly to control a trigger indicator circuit 26 and secondly to control the transmitter circuit of the third transducer 2 to cause it to generate a special type of alarm-triggering signal that corresponds, for example, to a given code and that is used firstly to identify the detector circuit concerned, i.e. the address of the corresponding mobile or movable object OM, and secondly a special message representative of the malfunction of the power supply of said circuit.

FIG. 5 also shows a particularly advantageously embodiment of an electrical power supply circuit 130 for the first, second and third transducers that comprises a self-contained power supply 25 making it possible to charge one or other of the rechargeable batteries 1301 and 1302 of the system. This self-contained power supply system may be constituted, for example, by a photovoltaic cell or by a battery of photovoltaic cells given reference 25 in FIG. 2*a* and in FIG. 5.

When the switch 1303 is switched over, said switch being implemented in the form of a double pole changeover switch, firstly one of the batteries 1302 is connected to the regulator 1304 while the other rechargeable battery 1301 is directly connected to the photocell 25, thereby enabling the rechargeable battery 1301 to be recharged, and secondly, when the switch 1303 is in the opposite position, the inverse situation obtains.

A system has thus been described for surveillance of a mobile or movable object that is particularly effective insofar as each mobile or movable object under surveillance can be associated with a detector of the kind described above in the description, said detector providing dedicated surveillance of the corresponding mobile or movable object by transmitting the address thereof.

It may be observed that in general and preferably but in non-limiting manner, the operation of the system of the present invention should be performed away from powerful light as given off by discharge lamps. However, in order to remedy this kind of drawback, it may also be observed that the trigger control signal scda may be itself triggered by switching on fluorescent lighting or by a photographic flash, thus making it possible to provide additional protection.

As shown in FIG. 2*a*, for example, it may also be observed that as a function of the sensitivity and the configuration of the correlation circuit 160, it is possible to generate an untimely prealarm signal referenced scpa, for example in the event solely of relative displacement occurring between the mobile or movable object OM under surveillance relative to the detector. This option provides the advantage, for example, of indicating the presence of strong drafts in exhibition halls in which large paintings are hung, for example, where such drafts could damage the paintings on display.

Finally, it may be observed that the application of the system for surveillance of a mobile or movable object in accordance with the invention is not limited to surveillance of art objects. Given the structure and the function of the detector 100 as used, it can also be used as a volume-measuring detector, as a detector for detecting a reference position relative to a fixed plane, or as a detector responding to a combination of the above-specified functions.

Thus, when operating as a volume-measuring detector, In1 may be set to 1 and In2 may be set to 0, when operating as a reference position detector, In1 may be set to 0 and In2 may be set to 1, and when operating as a combination of both the above functions, both In1 and In2 may be set to 1, as shown in FIG. 3*c*. The combination In1=In2=0 may be reserved for transmitting a message representative of malfunction of the power supply circuit.

When the detector 100 is operating as a volume-measuring detector, the system of the present invention may be used in a manner that is particularly advantageous for surveillance of motor vehicles parked in a parking area.

Under such circumstances, the detector 100, as shown in FIG. 6, may advantageously be placed on one branch of a U-shaped support whose other branch carries the third transducer 2 which is mechanically separate from the box 100 but which is connected to the first and second transducers 110, 111; 120, 121 via electrical links 2001 embedded in the body of the branch of the U-shaped support.

In a particular application, as shown in FIG. 6, and as described in U.S. Pat. No. 4,155,067, the concave portion of the U-shaped support may be fitted over the door window of a vehicle under surveillance, the detector 100 proper being inside the vehicle, and the third transducer 2 or a transmission relay therefor being located outside the vehicle. The alarm transmission relay 3 can then be placed on a beacon located outside. The link between the third transducer 2 and the relay 3 is then preferably implemented by an electromagnetic microwave, for example, in order to ensure good transmission of call messages MA and of reply messages MR, regardless of the state of the atmosphere outside.

I claim:

1. A system for surveillance of a mobile or movable object placed in a surveillance enclosure, said system comprising:

transmitter/receiver means for first and second object-monitoring signals (sco1, sco2), said first object-monitoring signal serving to monitor the presence of the object and said second object-monitoring signal serving to monitor the position of the object; and transmission means for transmitting an alarm-triggering signal, said transmission means receiving said first and second object-monitoring signals and conditionally enabling said alarm-triggering signal to be transmitted on the basis of a function combination, said function combination belonging to the group consisting of logical, analog, and logical and analog functions of said first and second object-monitoring signals.

2. A system for surveillance according to claim 1, wherein said transmitter/receiver means and said transmission means are constituted respectively by:

transmitter/receiver first and second transducers; and a transmission third transducer, said first, second, and third transducers being transducers belonging to the group consisting of transducers for electromagnetic and transducers for ultrasound waves, and being mounted in a box constituting the surveillance detector for the mobile or movable object.

3. A system for surveillance according to claim 2, wherein said transmitter/receiver first and second transducers serve to generate and receive waves belonging to the group consisting of electromagnetic and ultrasound waves that are amplitude-modulated at a determined duty ratio and modulation frequency, the transmission and the reception of said waves being implemented for each transducer over a solid surveillance angle directed towards the mobile or movable object under surveillance that is proportional to a distance d1 for said first transducer and to a distance d2 for said second transducer to the fixed plane of the surveillance enclosure taken as a reference plane, respectively, said transmitter/receiver first and second transducers delivering said first and second object-monitoring signals.

4. A system for surveillance according to claim 3, wherein said transmitter/receiver first and second transducers are constituted respectively by:

a transmitter diode disposed on a first face of said box constituting the detector for surveillance of the mobile or movable object for said first transducer; and a receiver diode disposed on said first face of said box for said first transducer, said transmitter and receiver diodes constituting the transmitter/receiver second transducer being disposed on a second face of said box, opposite to said first face.

5. A system for surveillance according to claim 4, wherein said box forming the detector for surveillance of said mobile or movable object comprises:

electrical power supply means for said first, second and third transducers;

generator means for generating a transmission signal that is pulse modulated at a predetermined duty ratio and repetition frequency, said transmission being delivered to said transmission diodes constituting said transmitter/receiver first and second transducers;

demodulator means comprising first and second demodulation paths (A,B), each demodulation path being connected to the corresponding transmitter/receiver first and second transducer, and comprising at least one envelope detector for the signal delivered by each reception diode of the corresponding transmitter/receiver first and second transducer, said envelope detector of the first and second demodulation path delivering a signal that constitutes the first and second object-monitoring signal (sco1, sco2) respectively; and cross-correlation means receiving said first and second object-monitoring signals thereby enabling a conditional transmission of the alarm signal.

6. A system for surveillance according to claim 5, wherein said electrical power supply means for said first, second, and third transducers comprise a self-contained electricity generating system enabling a storage battery to be recharged.

7. A system for surveillance according to claim 3, wherein said transmission third transducer includes a diode for transmitting an encoded wave constituting said alarm-triggering signal, said encoded wave being transmitted towards an alarm trigger relay element disposed on the surveillance enclosure for receiving said alarm-triggering signal and being connected to a surveillance center.

8. A system for surveillance according to claim 7, wherein said alarm trigger relay element comprises at least a plurality of reception diodes distributed over a hemispherical surface so as to enable said alarm-triggering signal to be received over an angle of 180° in elevation and in azimuth.

9. A system for surveillance according to claim 7, wherein said connection between said transmission third transducer and said alarm trigger relay element is backed up by an optical fiber link.

10. A system for surveillance according to claim 3, further comprising an alarm trigger relay element, said transmission third transducer including a diode for transmitting an encoded wave constituting said alarm-triggering signal, and said encoded wave being transmitted towards said alarm trigger relay element.

11. A system for surveillance according to claim 3, further comprising an alarm trigger relay element, and further comprising a plurality of units each comprising said transmitter/receiver means and transmission means for monitoring a respective mobile or movable object, each said transmission means comprising a transmission transducer; said alarm trigger relay element includes at least one transmitter/receiver element enabling an encoded call message (MA) to be issued periodically to each of said transmission transducers, each of said transmission transducers itself being formed by a transponder suitable for responding to said encoded call message by generating an encoded reply (MR) indicating that the respective mobile or movable object under surveillance is safely present.

12. A system for surveillance according to claim 2, further comprising an alarm trigger relay element, and further comprising a plurality of units each comprising said transmitter/receiver means and transmission means for monitoring a respective mobile or movable object, each said transmission means comprising a transmission transducer; said alarm trigger relay element includes at least one transmitter/receiver element enabling an encoded call message (MA) to be issued periodically to each of said transmission transducers, each of said transmission transducers itself being formed by a transponder suitable for responding to said encoded call message by generating an encoded reply (MR) indicating that the respective mobile or movable object under surveillance is safely present.

13. A system for surveillance according to claim 1, further comprising an alarm trigger relay element disposed on the surveillance enclosure, said alarm trigger relay element being designed to receive said alarm-triggering signal and being connected to a surveillance center.

14. A system for surveillance according to claim 13, further comprising a plurality of units each comprising said transmitter/receiver means and transmission means for monitoring a respective mobile or movable object, each said transmission means comprising a transmission transducer; said alarm trigger relay element includes at least one transmitter/receiver element enabling an encoded call message (MA) to be issued periodically to each of said transmission transducers, each of said transmission transducers itself being formed by a transponder suitable for responding to said encoded call message by generating an encoded reply (MR) indicating that the respective mobile or movable object under surveillance is safely present.

15. A system for surveillance according to claim 14, wherein said alarm-triggering signal is constituted, for a given mobile or movable object, by a plurality M of encoded reply messages being absent consequently.

16. A system for surveillance of a mobile or movable object according to claim 1, wherein said conditional transmission of said alarm-triggering signal is implemented on the basis of said function combination of said first and second object-monitoring signals satisfying the following relationship:

NOT[f(d1,d2)=A]=1 where f(d1, d2) designates a function of distance variables d1 and d2 of the mobile or movable object under surveillance, NOT designates a variation or difference between the value of said function relative to a reference value A for the object under consideration, at which said object is in safety.

17. A system for surveillance according to claim 16, wherein said function f(d1, d2)=A is a function combination, said function combination belonging to the group consisting of logical, arithmetic, and logical and arithmetic functions of said distance variables d1 and d2 which belong to the group consisting of logic and analog variables, respectively.

18. A system for surveillance of a mobile or movable object according to claim 1, wherein said first object-monitoring signal is a function of a distance d1 between the mobile or movable object under surveillance and the active portions of said transmitter/receiver means.

19. A system for surveillance of a mobile or movable object according to claim 1, wherein said second object-monitoring signal is a function of a distance d2 between the mobile or movable object under surveillance and a fixed plane of the surveillance enclosure taken as a reference plane.

* * * * *